United States Patent [19]

Hubbard

[11] Patent Number: 5,054,380

[45] Date of Patent: Oct. 8, 1991

[54] EXTERNAL BOOSTER FOR FORCED AIR HEATING AIR CONDITIONING SYSTEM

[76] Inventor: Elizabeth S. Hubbard, 2750 Mohawk La., Rochester Hills, Mich. 48064

[21] Appl. No.: 552,475

[22] Filed: Jul. 16, 1990

[51] Int. Cl.[5] ..... F24F 7/06

[52] U.S. Cl. ..... 98/103

[58] Field of Search ..... 98/39.1, 101, 103, 108

[56] References Cited

U.S. PATENT DOCUMENTS

| | | | |
|---|---|---|---|
| 1,426,900 | 8/1922 | Neal | 98/103 X |
| 3,148,613 | 9/1964 | Koon | 98/101 |
| 4,722,266 | 2/1988 | Deckert | 98/103 |
| 4,809,593 | 3/1989 | Asselbergs | 98/103 |

*Primary Examiner*—Harold Joyce

*Attorney, Agent, or Firm*—Krass & Young

[57] ABSTRACT

An external, air circulation booster which fits over a register of a forced air central air conditioning and heating system. The booster includes a housing having front, rear, side and top panels, and an air intake shroud formed on the bottom of the housing. The air intake shroud includes an air intake grill which fits over a portion of the outlet aperture of the register. An air discharge grill is formed on the front panel of the housing. A radial impellar is mounted in the side of the housing, and air radially expelled therefrom toward the side and rear of the housing is redirected by means of a baffle out the discharge grill.

9 Claims, 3 Drawing Sheets

EXTERNAL BOOSTER FOR FORCED AIR HEATING AIR CONDITIONING SYSTEM

BACKGROUND OF THE INVENTION

1. Field of the Invention

This invention relates to the field of fan devices for augmenting air circulation through forced air air conditioning and heating systems and, more particularly, to such a device designed to fit externally over a forced air register.

2. Description of the Relevant Prior Art

Due to their inherent advantages, forced air central heating and cooling systems have become the dominating means of both residential and commercial climate control in the United States within recent years. Since such installations include a system of ducts for conducting forced air to individual rooms, such systems can be adapted to both centrally heat and cool a building. Typically, a central heating and/or cooling unit acclimatizes outside air to a comfortable temperature set by a thermostat and a central blower is used to circulate the tempered air throughout the ducts to heat or cool the rooms of the building.

Problems can arise in circulating the acclimatized air to more remote portions of the building, or to upper stories thereof. According to the laws of fluid mechanics and air flow, as the column of air to be moved lengthens, air flow measured in cubic feet per second becomes diminished. Thus, it may become necessary to provide an auxiliary air circulating fan in order to provide sufficient air flow to more remote parts of a building.

This problem is particularly acute when a forced air system is used to air condition a building having two or more stories. The air cooled by the central air conditioner is relatively heavy and hard to move. It is more difficult to overcome gravity and supply such cooled air to the upper stories of a building than it is to supply air warmed by a furnace. Hence, it is not uncommon for the second floor rooms of a house to remain uncomfortably warm during the hot summer months even though the central air conditioning unit is in use. One is forced to choose between lowering the thermostat to boost the output of the air conditioning unit, thereby cooling the lower story to an uncomfortable level and wasting energy or tolerating uncomfortably warm temperatures in the upper story rooms. In fact, it is not uncommon for the dwellers to supplement forced air central air conditioning by installing expensive individual air conditioners in second story bedrooms. Obviously, such a solution is wasteful and unsatisfactory.

It has long been known to boost air circulation from a forced air unit by installing auxiliary fans inside the ducts of the system. For example, U.S. Pat. No. 4,798,518 discloses such an auxiliary fan unit for use with the duct system of an air conditioning and ventilation system. The fan unit disclosed in the referenced patent has a freely turning radial impeller and associated drive motor. A guiding structure is provided downstream from the outlet of the impeller which directs the air flow coming radially from the impeller to an axial direction. In other words, this device redirects the air flow through an angle of approximately 90°.

Another example of an in-duct circulation booster is shown in U.S. Pat. No. 3,099,201. However, these devices and others like them suffer from obvious disadvantages. Since they must be installed in the ductwork, installation is cumbersome and difficult. Moreover, the unit must be exactly sized to fit inside the ductwork. Since these devices must be permanently installed, they cannot be moved from location to location as desired.

It is also known to provide an air circulation booster as an external unit to be fitted over the aperture of a forced air register. Examples of such devices are shown in U.S. Pat. Nos. 4,722,266 and 4,846,399. While these devices have the advantage of being portable and requiring no expensive installation, the relatively small and inefficient fans used in these devices limit their utility. The average second floor register exhibits about 0.6 inches of water back pressure. The weight of the column of air and the viscous drag of the air against the walls of the ductwork act to restrict air flow; and, if any air is to flow out of the register, it must experience a pressure differential greater than 0.6 inches of water. Hence, an external booster must be as efficient as possible to overcome this static back pressure. Furthermore, an external booster must efficiently and effectively couple to the air handling system. Also, it would be highly desirable that any external air flow booster be simple to install and remove.

SUMMARY OF THE INVENTION

The invention described and claimed herein is designed to overcome the disadvantages noted in the prior art. The device of the present invention is adapted to fit over an air register of a forced air heating and air conditioning system. It includes a housing which defines an interior, which housing has a top wall, front, rear and opposed side panels, and a continuous skirt disposed along the bottom edges of the panels. The skirt is designed to seal the interior of the housing from the ambient atmosphere of a room when the booster is placed over the register. A radial flow impeller and drive motor operatively associated therewith are mounted in the interior of the housing proximate the top wall thereof with the blades of the impeller extending downward. The impeller discharges air drawn through an intake grill out in a radial direction.

The intake grill is disposed on an air intake shroud formed on the bottom of the housing. The intake grill is dimensioned to cover at least a portion of the outlet aperture of the register. The shroud surrounds the air intake grill and isolates the air drawn through the air intake grill from the rest of the interior of the housing. An air discharge grill is formed on the front panel of the housing.

The external booster further includes a baffle disposed in the interior which is configured as a continuous, curved wall beginning at a first end of the air discharge grill and terminating at the second end thereof. The continuous curved baffle defines an open curve. The baffle extends axially beyond the blades of the impeller t terminate at the bottom of the housing. The baffle is spaced from the impeller at a distance so that air expelled radially from the impeller is redirected out the discharge grill mounted on the front panel when the device is in operation, thus greatly increasing the air flow from the forced air system.

Preferably, the front panel is inclined at an angle with respect to the rest of the housing. Because the air discharge grill is thus inclined, air discharged from the device is directed both outwardly and upwardly to bolster circulation in the room. Preferably, a variable switch in the form of a rheostat is provided so that the speed and power of the booster may be adjusted as desired.

In a preferred embodiment, the intake shroud includes a flat base which has an aperture formed therein to permit air flow therethrough, thereby creating a free edge. A tapering sleeve is formed on the free edge of the base which tapers inwardly toward the bottom of the device. A flat bottom panel is formed on the end of the tapering sleeve, and the intake grill is disposed on the bottom panel.

BRIEF DESCRIPTION OF THE DRAWINGS

The following detailed description may best be understood by reference to the following drawings in which.

DETAILED DESCRIPTION OF THE PREFERRED EMBODIMENT

Figure 1:
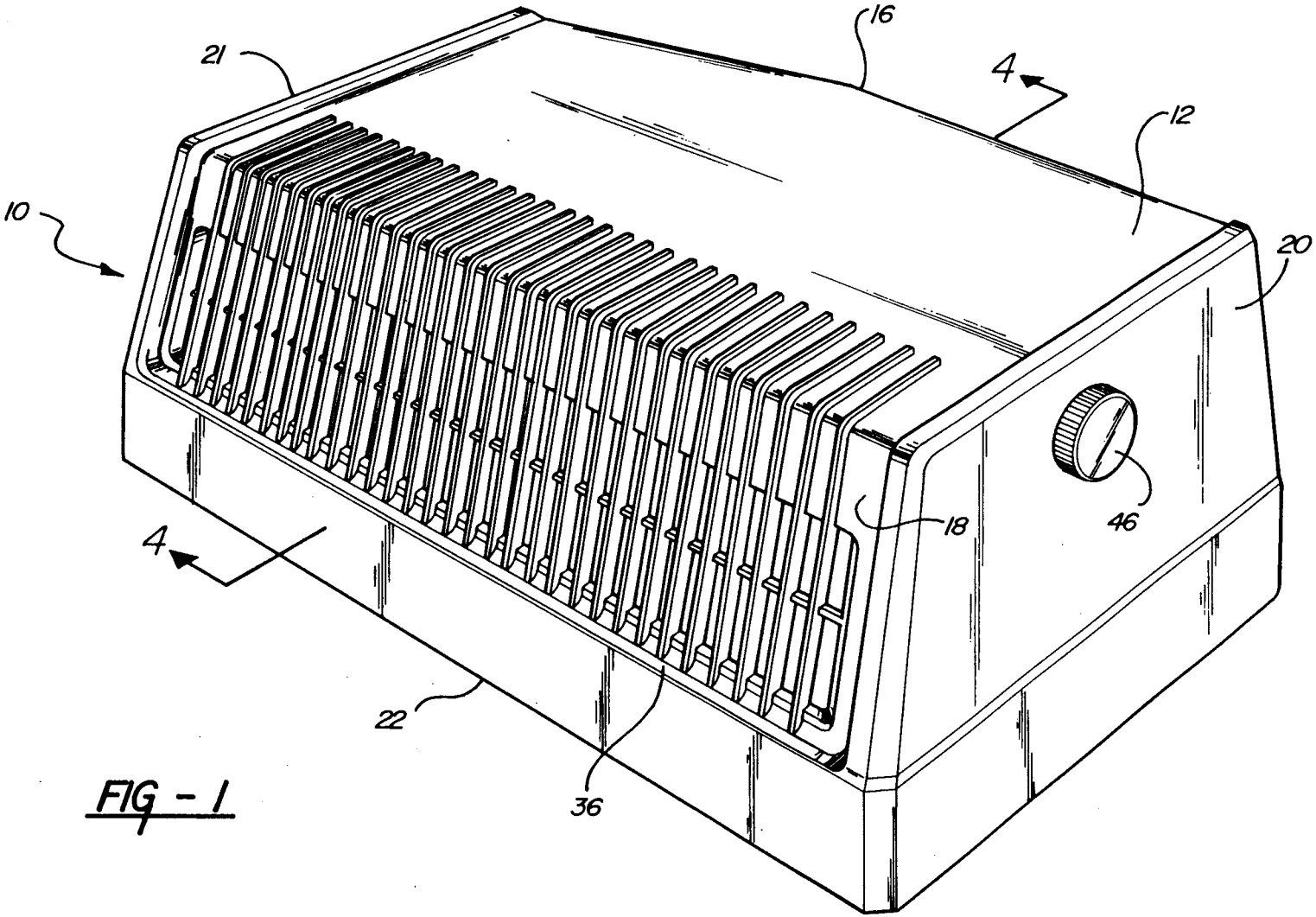
FIG. 1 is a perspective view of an external booster constructed in accordance with the principles of the present invention.
Figure 4:
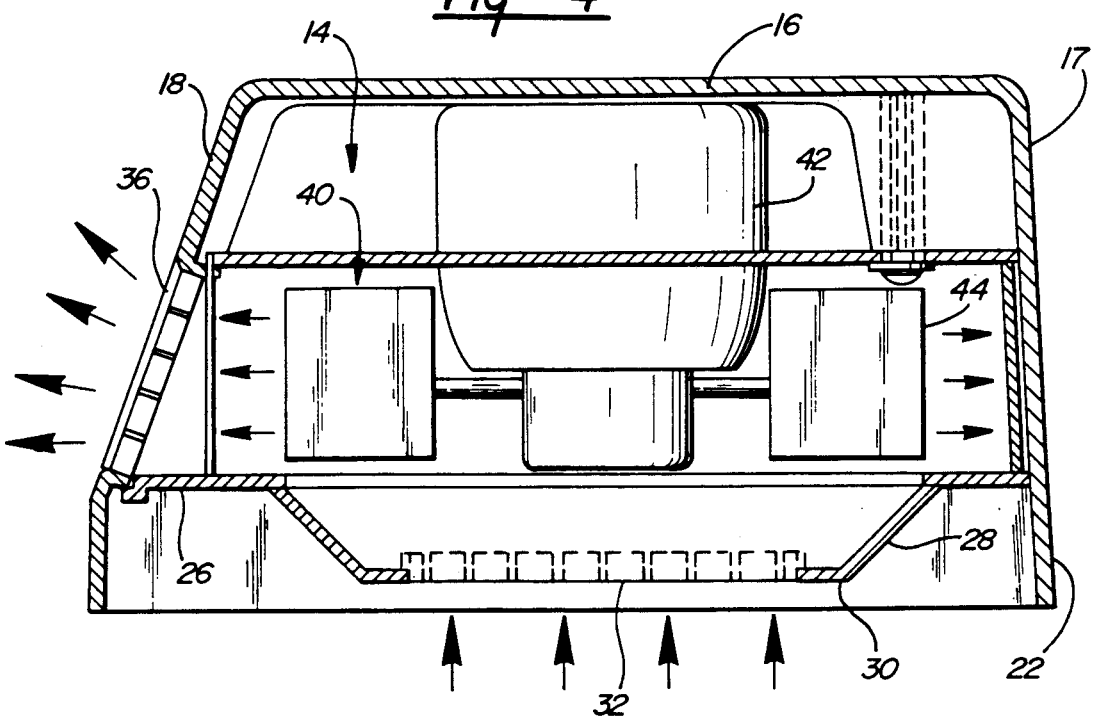
FIG. 4 is a cross section view of the device of FIG. 1 taken along lines IV—IV.

Throughout the following detailed description, like reference numerals are used to reference the same element of the present invention shown in multiple figures thereof. Referring now to the drawing and in particular to FIGS. 1 and 4, there is shown an external booster 10 for increasing the flow of air through a duct of a forced air, central heating and air conditioning system (not depicted.) The booster 10 comprises a housing 12 defining a interior 14. The housing 12 includes top, back, front, and side panels 16, 17, 18, 20, 21, respectively. Disposed along a bottom edge of the housing 12 is a skirt 22. As can be seen in FIG. 4 the skirt 22 extends below the interior 14 of the housing and serves to isolate the interior 14 from the ambient environment. An air discharge grill 36 is formed on the front panel 18 of housing 14. Front panel 18 is inclined forwardly with respect to the remainder of housing 14 as is best shown in FIG. 4.

Figure 2:
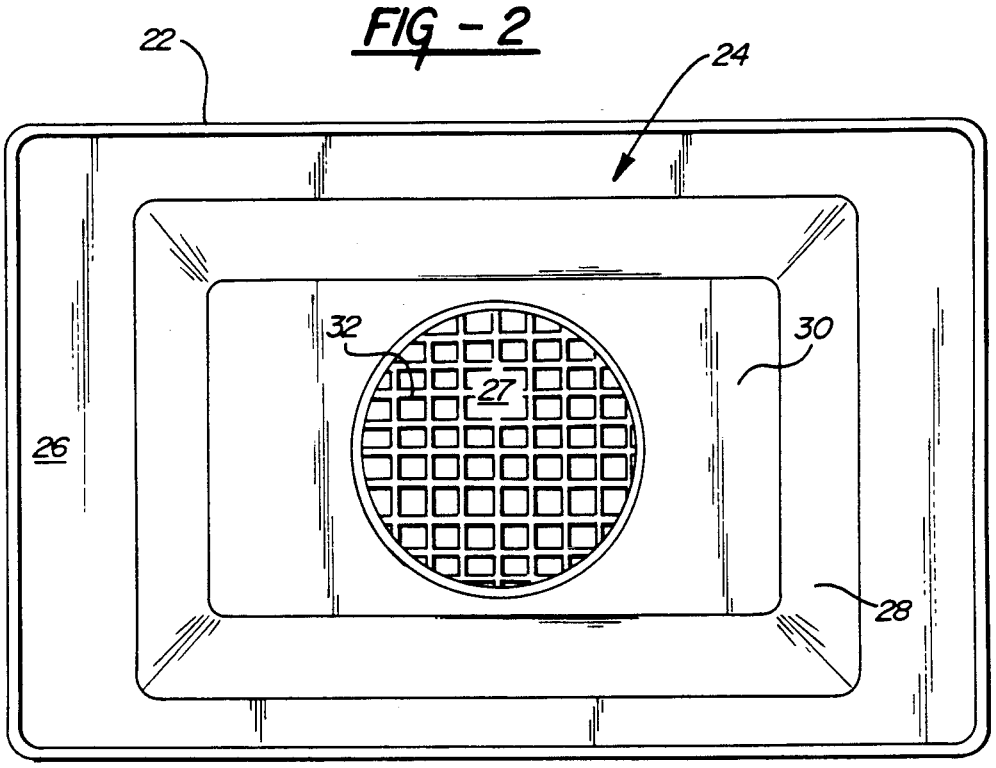
FIG. 2 is a bottom plan view of the device of FIG. 1.

As is best seen in FIG. 2, the bottom of the housing 14 is defined by an air intake shroud 24. Shroud 24 comprises a base 26 disposed adjacent the skirt 22 and further includes a tapering sleeve 28 formed thereon. Tapering sleeve 28 tapers inwardly toward the bottom of housing 14 and formed on the end of tapering sleeve 28 is a flat, bottom panel 30. An aperture 27 covered by an intake grill 32 which is disposed on bottom panel 30. The housing 14 and the intake grill 32 are dimensioned such that, when the device 10 is placed over the air intake aperture of a register (not shown) of the forced air system, the intake grill 32 will cover at least a portion of the register aperture and the skirt 22 will be disposed around the periphery thereof.

Figure 5:
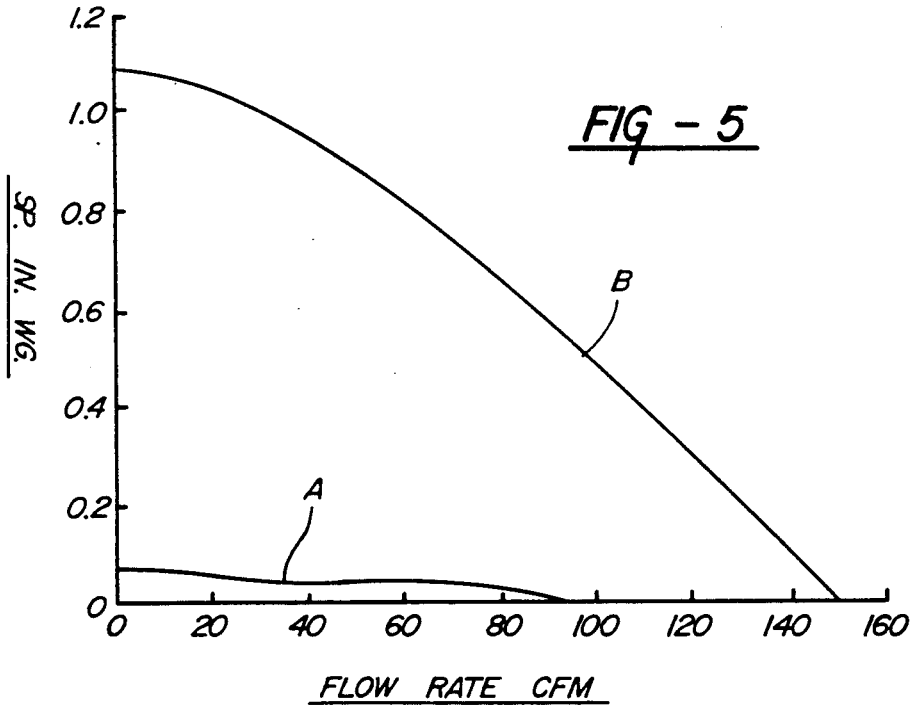
FIG. 5 is a flow rate versus pressure chart depicting the performance of the device of the present invention compared with a prior art device and illustrating the advantages thereof.

Referring back to FIG. 4: disposed in the interior 14 of housing 12 is a radial impeller 40 and drive motor 42 associated therewith. Motor 42 is aligned coaxially with impeller 40 and mounted proximate the top panel 16 of housing 12. The blades 44 of impeller 40, thus, extend in a downward direction. By means of radial impeller 40, air is drawn in through intake grill 32 is redirected radially and outwardly in a manner depicted by the arrows shown in FIG. 4. There are a number of different fan-motor combinations of the type described herein, which are commercially available and in view of the disclosure herein, particularly the disclosure of FIG. 5, one of skill could readily select an appropriate combination. One preferred fan-motor configuration is available from EBM Industries Inc. of Connecticut and sold under the designation R 25 133 AB 25-22. This particular fan-motor combination operates at 110 volts and is capable of establishing an air flow of 80–100 CFM against a back pressure cf 0.6 inches of water when incorporated in the booster of the present invention.

Figure 3:
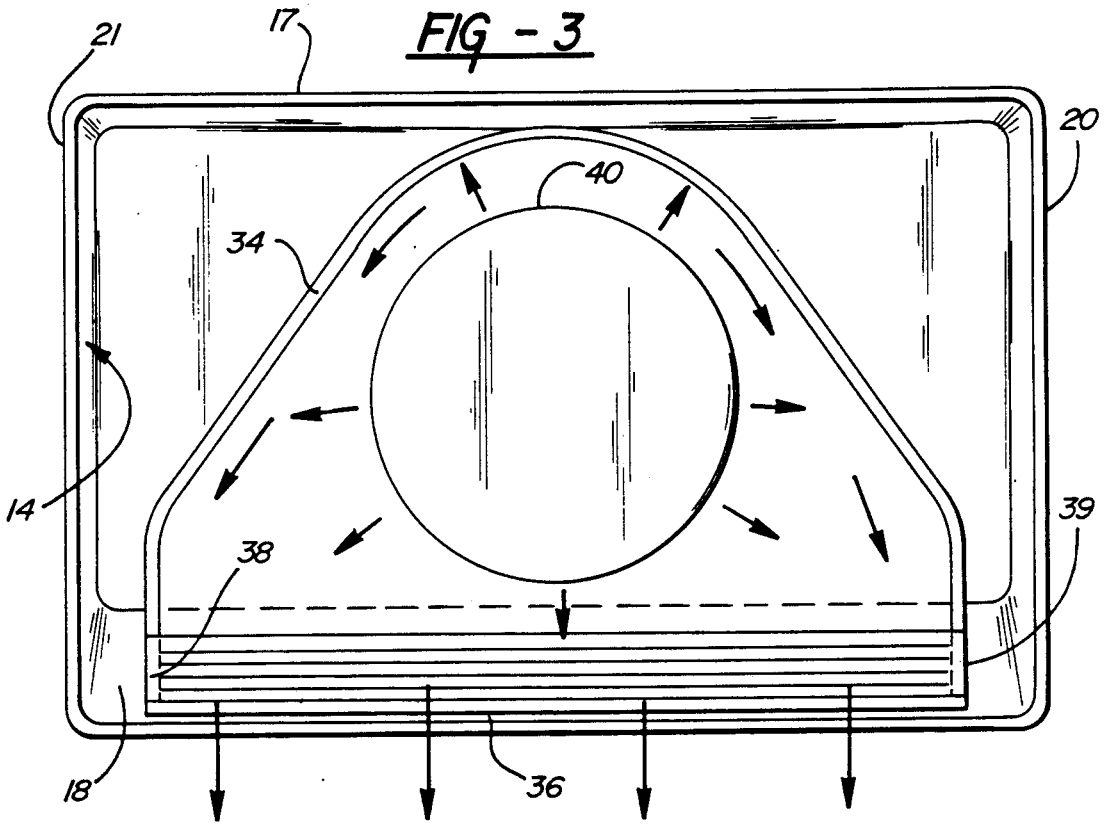
FIG. 3 is a bottom, interior view of the device of FIG. 1 with the intake shroud removed and the impeller depicted schematically.

Some of the air radially redirected by impeller 40 will be redirected toward front panel 18 and out discharge grill 36. However, a large portion of the redirected air will flow toward the back and side panels 17, 20, 21. To increase the efficiency of the device, a baffle 34 is provided which is configured in the manner shown in FIG. 3. Baffle 34 takes the form of a wall which defines a continuous, open curve and starts at a first end 38 of discharge grill 36 and terminates at a second end 39 thereof. A particularly effective configuration of baffle 34 is depicted in FIG. 3. It will readily be seen that baffle 34 is spaced a distance from the ends of the blades 44 of impeller 40. This arrangement causes air redirected by impeller 40 radially toward the back and side panels 17, 20 and 21 to be deflected so that it flows out discharge grill 36. Thus, the design of the baffle 34 permits virtually all of the air redirected radially by impeller 40 to be directed out the discharge grill 36, as is shown by the arrows depicted in FIG. 3. Such an arrangement greatly increases the efficiency of the booster of the present invention.

The device of the present invention may be used in a number of different ways. For example, the device may be mounted over a floor register by simply placing the device over the register, thereby enclosing and isolating it. If the floor in which the register is located is carpeted, an effective seal from the outside atmosphere will be formed by skirt 22 with the carpet. If the device is to be placed on a bare floor, a rubber gasket (not shown) may optionally be disposed around the bottom edge of the skirt 22 to effect a seal. It is important to at least partially seal the interior 14 from the surrounding atmosphere to prevent escape of air discharged from the register before it is redirected and its velocity increased by action of the impeller and also to prevent the impeller from drawing room air in preference to air in the duct of the heating/cooling system. If the register is located on a wall, the device may be mounted thereto by means of mounting brackets (not shown.)

Typically, such a device might be used in, for example, a second floor bedroom. The device may be turned on a high setting by means of variable switch 46 (preferably a rheostat) in order to quickly increase the flow rate of, for example, cool air discharged from the register. After a short period of operation on the high setting, the switch 46 may be moved to a lower setting to save energy. The high setting will have the effect of rapidly cooling the room and the lowered setting will maintain the cool temperature. Obviously, the same system could be used to increase the flow of heated air in the winter months, if necessary.

The device of the present invention may also be used to increase the air flow through the room even when the forced air system is not in operation. For example, if the forced air heating and cooling system is located in the basement, causing a positive air flow through the ductwork of the system will cause cooler basement air to move into an upper story room. If the device of the present invention is in operation, a positive air flow will be created which, on some days, may be sufficient to cool the room without the necessity of using the central air conditioning unit. This will result in a significant savings of money and energy.

The booster of the present invention is low profile and unobtrusive in appearance. The radial impeller used to redirect the air is quiet in operation and much more efficient than the axial fans used in prior art devices. Furthermore, the device is configured to create an efficient and substantially complete seal with the underlying floor or wall. Hence, the device is much more effective than any prior art device. The results of actual efficiency test performed on the device of the present invention versus a typical prior art device are depicted graphically in FIG. 5. The flow rate in cubic feet per minute is plotted against typical values for back pressure (measured in inches of water) found in forced air systems. As can be seen, the prior art device depicted by curve A is effective only at back pressures of less than 0.1 inches of water. For example, at 0 inches of water back pressure, the prior art device succeeds in producing a flow rate of approximately 95 cubic feet per minute. However, this flow rate becomes drastically reduced as backflow, approaches 0.1 and becomes 0 well before that point. In other words, the prior art device completely ceases to be effective at backflow pressures approaching 0.1. Since typical back pressure readings for forced air systems are around 0.6 inches of water, the prior art device is totally ineffective in ordinary use.

The performance of the booster device of the present invention is depicted by curve B. Again, as one would expect, the device is most effective at 0 back pressure; the booster achieved a maximum flow rate of approximately 160 cubic feet per minute. As the back pressure is increased, the flow rate drops off. However, in contrast to the prior art device, the drop off is much less severe. For example, a typical back pressure of 0.6 inches of water, the device of the present invention maintains a flow rate of over 80 cubic feet per minute, a performance almost as good as the prior art device exhibits with no back pressure. Only when the back pressure is increased to over 1 inch of water does the booster of the present invention cease its effectiveness. However, back pressures of this order of magnitude are not normally encountered in central, forced air installations. Because of the nature of the fan employed and the particular configuration of the booster housing, the device of the present invention is effective through a typical range of back pressures, in contrast to the prior art.

The booster of the present invention has been described with reference to certain embodiments and exemplifications thereof. Doubtless, variations in design may occur to one skilled in the art without departing from the scope of the subject matter claimed herein. The true scope of the present invention is defined solely by the claims appended hereto.

I claim:

1. An external booster adapted to fit over an air register of a forced air heating and/or air conditioning system, said booster comprising:

a housing defining an interior and having a top wall, front, rear and opposed side panels, and a continuous skirt disposed along bottom edges of said panels for sealing the interior of said housing when the booster is placed over the register;

an air intake shroud formed on the bottom of said housing and including an air intake grill dimensioned to cover at least a portion of an outlet aperture of said register;

an air discharge grill formed on said front panel;

a radial flow impeller and drive motor operatively associated therewith for directing system air taken in through the intake grill in a radial outward direction, said impeller and motor being mounted in said interior proximate the top wall of the housing with blades of the impeller extending downward; and an air redirecting baffle disposed in said interior radially outward from a portion of the circumference of said impeller and configured as a continuous curved wall beginning at a first end of said air discharge grill and terminating at a second end thereof and defining an open curve, spaced at a distance from the impeller so that air expelled radially from the impeller toward the rear and side panels of the housing is redirected out said discharge grill when the booster is in operation, thereby increasing the air flow from the system.

2. The booster of claim 1 wherein the extends axially beyond the blades of the impeller to terminate proximate the bottom of the housing.

3. The booster of claim 1 further comprising a variable switch in electrical communication with the motor and operable therewith for controlling the speed of the impeller.

4. The booster of claim 3 wherein the variable switch comprises a rheostat.

5. The booster of claim 1 wherein the air intake shroud further comprises a flat base with an aperture formed therein to permit air flow therethrough; a tapering sleeve joined to an edge of the base and tapering inwardly toward the bottom of the housing; and a flat bottom panel formed on an end of the tapering sleeve, said intake grill being disposed on the bottom panel.

6. The booster of claim 1 wherein the front panel is inclined rearwardly with respect to the rest of the housing.

7. The booster of claim 1 wherein the curved wall further includes a portion having a radius of constant curvature disposed proximate the rear wall of the housing.

8. The booster of claim 1, wherein the impeller and drive motor are operative in cooperation to provide an air flow of approximately 80–100 CFM through said booster against a back pressure of 0.6 inches of water.

9. An external booster adapted to fit over an air register of a forced air heating and air conditioning system, said booster comprising:

a housing defining an interior and having a top wall, front, rear and opposed side panels, and a continuous skirt disposed along bottom edges of said panels for sealing the interior of said housing when the booster is placed over the register;

an air intake shroud formed on the bottom of said housing and including an air intake grill dimensioned to cover at least a portion of an outlet aperture of said register;

an air discharge grill formed on said front panel;

a radial flow impeller and drive motor operatively associated therewith for directing system air taken in through the intake grill in a radial outward direction, said impeller and motor being mounted in said interior proximate the top wall of the housing with blades of the impeller extending downward; and an air redirecting baffle means disposed in said interior and configured to redirect air expelled radially from the impeller toward the rear and side panels out the discharge grill when the booster is in operation, thereby increasing the air flow from the system.

* * * * *

UNITED STATES PATENT AND TRADEMARK OFFICE

CERTIFICATE OF CORRECTION

PATENT NO. : 5,054,380

DATED : October 8, 1991

INVENTOR(S) : Elizabeth S. Hubbard

It is certified that error appears in the above-identified patent and that said Letters Patent is hereby corrected as shown below:

Title page:

In the title, After "Heating" and before "Air", Please insert -- and --.

Column 2, Line 56, Please delete "t" and insert -- to --.

Column 4, Line 14, Please delete "cf" and insert -- of --.

Signed and Sealed this

Twenty-third Day of March, 1993

*Attest:*

STEPHEN G. KUNIN

*Attesting Officer*

*Acting Commissioner of Patents and Trademarks*